US008535399B2

(12) United States Patent
Chen et al.

(10) Patent No.: US 8,535,399 B2
(45) Date of Patent: Sep. 17, 2013

(54) USE OF HYDROXYALKANOIC ACID DERIVATIVES AS FUEL ADDITIVES

(75) Inventors: Guoqiang Chen, Shantou (CN); Rongcong Luo, Shantou (CN)

(73) Assignee: Shandong Lukang Pharmaceutical Co., Ltd., Jining, Shandong Province (CN)

( * ) Notice: Subject to any disclaimer, the term of this patent is extended or adjusted under 35 U.S.C. 154(b) by 13 days.

(21) Appl. No.: 12/994,330

(22) PCT Filed: May 26, 2009

(86) PCT No.: PCT/CN2009/000588

§ 371 (c)(1),
(2), (4) Date: Jan. 6, 2011

(87) PCT Pub. No.: WO2009/143706

PCT Pub. Date: Dec. 3, 2009

(65) Prior Publication Data

US 2011/0107660 A1 May 12, 2011

(51) Int. Cl.
*C10L 1/18* (2006.01)

(52) U.S. Cl.
USPC ..... 44/400; 44/388; 44/401; 44/402; 44/410

(58) Field of Classification Search
USPC ..... 44/400, 401, 402, 388, 410
See application file for complete search history.

(56) References Cited

U.S. PATENT DOCUMENTS

| | | | | |
|---|---|---|---|---|
| 6,191,321 | B1 | 2/2001 | Forschner et al. | |
| 6,719,815 | B2 * | 4/2004 | Nanninga et al. | 44/401 |
| 7,696,136 | B2 | 4/2010 | Migdal | |
| 2003/0061761 | A1 | 4/2003 | Nanninga | |
| 2005/0198894 | A1 | 9/2005 | Migdal | |

FOREIGN PATENT DOCUMENTS

| | | | |
|---|---|---|---|
| CN | 1414998 | | 4/2003 |
| CN | 1483824 | | 3/2004 |
| CN | 1844185 | | 10/2006 |
| CN | 1946833 | | 4/2007 |
| CN | 1814715 | | 11/2007 |
| EP | 0661376 | | 7/1995 |
| JP | 61127792 | | 6/1986 |
| JP | 562284526 | A | 12/1987 |
| JP | 562295956 | A | 12/1987 |
| JP | 11293262 | | 10/1999 |
| JP | 2003523452 | A | 8/2003 |
| JP | 2007528440 | A | 10/2007 |

OTHER PUBLICATIONS

Huang et al., 2001, "Production of Biodegradable Plastics by Fermentation of Active Sludge from Food Plant (I)", Agro-environmental Protection, 20(5): 329-332, 350 (English Translation of Abstract Attached).

(Continued)

*Primary Examiner* — Monique Cole
(74) *Attorney, Agent, or Firm* — Casimir Jones, S.C.

(57) ABSTRACT

The present invention is related to the use of hydroxyalkanoic acid derivatives as a fuel additive. In particular, the present invention provides the use of lower alkyl esters and/or salts of hydroxyalkanoic acid as biofuels and/or fuel additives. The present invention also provides a fuel composition including at least one fuel and lower alkyl esters and/or salts of hydroxyalkanoic acid.

7 Claims, 5 Drawing Sheets

(56) References Cited

OTHER PUBLICATIONS

Chen et al., 2001, "Production of Poly-3-Hydroxybutyrate (PHB) by Fermentation of Active Sludge from Food Plant (II)", Agro-environmental Protection, 20(6): 424-428 (English Translation of Abstract Attached).
Yue et al., 2004, "Formation of PHB in the Process of Ethanol Wastewater Biological Treatment", Technology of Water Treatment, 30(3): 150-152 (English Translation of Abstract Attached).
Yuan et al., 2003, "Production of Polyhydroxyalkanoates by a Mixed Culture", Acta Microbiologica Sinica, 43(6): 799-804(English Translation of Abstract Attached).
Roo et al., 2002, "Producation of Chiral R-3-Hydroxyalkanoic Acids and R-3-Hydroxyalkanoic Acid Methylesters via Hydrolytic Degradation of Polyhydroxyalkanoate Synthesized by Pseudomonads", Biotechnology and Bioengineering, 77(6): 717-722.
Lee et al., 1999, "Chiral Compounds from Bacterial Polyesters: Sugars to Plastics to Fine Chemicals", Biotechnology and Bioengineering, 65(3): 363-368.
Liu et al., 2007, "Productions and characterization of medium-chain-length polyhydroxyalkanoate with high 3-hydroxytetradecanoate monomer content by fadB and fadA knockout mutant of *Pseudomonas putida* KT2442", Appl Microbiol Biotechnol, 76: 1153-1159.
Satoh et al., 1998, "Activated Sludge as a Possible Source of Biodegradable Plastic", Wat. Sci. Tech., 38(2): 103-109.
Jiang et al., 2009, "Efficient Polyhydroxyalkanoates Production from a Waste-Activated Sludge Alkaline Fermentation Liquid by Activated Sludge Submitted to the Aerobic Feeding and Discharge Process", Environ. Sci. Technol., 43: 7734-7741.
Satoh et al., 1999, "PHA production by activated sludge", International Journal of Biological Macromolecules, 25: 105-109.
Luo et al., 2007, "Study of Miscibility, Crystallization, Mechanical Properties, and Thermal Stability of Blends of Poly(3-hydroxybutyrate) and Poly(3-hydroxybutyrate-co-4-hydroxybutyrate)", Journal of Applied Polymer Science, 105: 3402-3408.
Ouyang et al., 2007, "Production of Polyhydroxyalkanoates with High 3-Hydroxydodecanoate Monomer Content by fadB and fadA Knockout Mutant of *Pseudomonas putida* KT2442", Biomacromolecules, 8:2504-2511.
Chen et al., 2001, "Industrial scale production of poly(3-hydroxybutyrate-co-3-hydroxyhexanoate)", Appl. Microbiol. Biotechnol., 57:50-55.
Xi et al., 2000, "Hyperproduction of polyesters consisting of medium-chain-length hydroxyalkanoate monomers by strain *Pseudomonas stutzeri* 1317", Antonie van Leeuwenhoek, 78:43-49.
Zhang et al., 2009, "Application of (R)-3-Hydroxyalkanoate Methyl Esters Derived from Microbioal Polyhydroxyalkanoates as Novel Biofules", Biomacromolecules, 10(4): 707-11.
Iwamoto et al., 1994, "Production of biodegradable plastic PHA by excess sludge from anaerobic—aerobic activated sludge process." Proc Environ Eng Res 31 (1994), pp. 305-314 (English Translation of Abstract Attached).
Supplementary EP Search Report dated Nov. 14, 2011, EP Patent Application No. EP09753424.2.

* cited by examiner

● cell concentration(g/L) ▲ PHBHHx concentration(g/L)

■ PHBHHx content(wt%) ○ 3HHx content (mol%)

□ Glucose Concentration(g/L) △ Nitrogen Source Concentration(g/L)

USE OF HYDROXYALKANOIC ACID DERIVATIVES AS FUEL ADDITIVES

FIELD OF THE INVENTION

The present invention is related to the field of biofuel, and more particularly, the present invention is related to the use of lower alkyl esters and/or salts of hydroxyalkanoic acid as biofuels and/or fuel additives.

BACKGROUND OF THE INVENTION

Energy is the basis of human activity. Humans are facing the exhaustion of fossil fuels, and the environmental pollution caused by fossil fuels is serious. Nowadays, almost all industrial countries are facing the crisis of energy supply.

Renewable energy is a kind of clean energy, meaning the energy that can be continuously renewed and sustainably used in the nature, in which biodiesel and fuel ethanol are striking. Biodiesel is a mixed liquid fuel of various monoesters of fatty acids obtained from animal or plant grease and short chain alcohols via transesterification, and can be used directly in an internal-combustion engine. Fuel ethanol is a high-octane fuel with the property of clean combustion and can be produced by renewable energy. However, the production of biofuels in large scale may require a large area of lands. Furthermore, the expansion of biofuels production such as ethanol production will also affect the price of grains. Therefore, the development of new energy is an urgent requirement.

Polyhydroxyalkanoates (PHA) are a kind of energy and carbon source storage materials accumulated by microorganisms under circumstances where the growth of microorganisms is unbalanced (Doi & Steinbüchel, 2002). The monomers forming PHA are various. Until now, more than 100 monomers have been discovered (Doi & Steinbüchel, 2002). 3-hydroxybutyric acid (3HB) is the most common monomer to form PHA. Typically, PHA can be represented by the following formula:

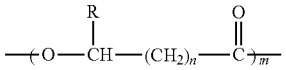

wherein n=1, 2, 3 or 4; typically n=1, i.e., poly-3-hydroxyalkanoate. m represents polymerization degree, which determines the molecular weight. R is a variable group, which can be saturated or unsaturated alkyl with a straight chain or branched chain and substituents.

When "R—" group is a substituent with less than 3 carbon atoms (that is, $CH_3$— or $CH_3CH_2$—), PHA is called Short Chain Length PHA (abbreviated as scl PHA). In particular, when "R—" group is $CH_3$—, PHA is called poly-3-hydroxybutyrate (abbreviated as PHB). When "R—" group is $CH_3CH_2$—, this PHA is called poly-3-hydroxyvalerate (abbreviated as PHV). 3-hydroxybutyric acid and 3-hydroxyvaleric acid can be polymerized to form poly-3-hydroxybutyrate-3-hydroxyvalerate (abbreviated as PHBV). The common examples of short chain length PHAs are PHB and PHBV. When "R—" group is a substituent comprising 3 or more carbon atoms, it is called Medium or Long Chain Length PHA.

The ester bonds in PHA can be broken to generate monomers under alcoholysis catalyzed by sulfuric acid. However, when methanol or ethanol is added during the alcoholysis, carboxyls (—COOH) in hydroxyalkanoic acid (HA) monomers generated from the degradation of PHA can react with the hydroxyls (—OH) in methanol or ethanol to generate corresponding methyl 3-hydroxyalkanoate or ethyl 3-hydroxyalkanoate (e.g. methyl 3-hydroxybutyrate or ethyl 3-hydroxybutyrate; methyl medium chain length hydroxyalkanoate or ethyl medium chain length hydroxyalkanoate).

SUMMARY OF THE INVENTION

In an aspect, the present invention provides the use of a compound of formula (I) as a fuel,

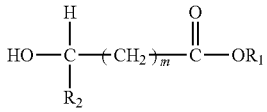

(I)

wherein, m is an integer ranging from 0 to 3; $R_1$ is selected from the group consisting of $C_1$-$C_5$ alkyl; and $R_2$ is selected from the group consisting of H and $C_1$-$C_{17}$ alkyl.

Preferably, $R_1$ is $C_1$, $C_2$ or $C_3$ alkyl.

Preferably, $R_2$ is selected from the group consisting of $C_1$-$C_9$ alkyl; more preferably, $R_2$ is $C_1$, $C_2$ or $C_3$ alkyl.

According to a preferred embodiment of the present invention, the compound of formula (I) is selected from the group consisting of methyl 3-hydroxybutyrate; ethyl 3-hydroxybutyrate; methyl 4-hydroxybutyrate; methyl 3-hydroxyvalerate; ethyl 3-hydroxyvalerate; methyl 3-hydroxyhexanoate; ethyl 3-hydroxyhexanoate; methyl lactate; and ethyl lactate.

In another aspect, the present invention provides the use of a compound of formula (I) as a fuel additive,

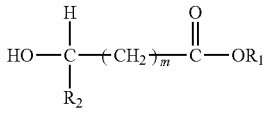

(I)

wherein, m is an integer ranging from 0 to 3; $R_1$ is selected from the group consisting of $C_1$-$C_5$ alkyl and alkali metal ions; and $R_2$ is selected from the group consisting of H and $C_1$-$C_{17}$ alkyl.

In still another aspect, the present invention provides a fuel composition, comprising at least one fuel; and a compound of formula (I)

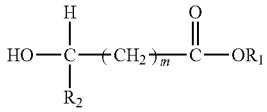

(I)

wherein, in is an integer ranging from 0 to 3; $R_1$ is selected from the group consisting of $C_1$-$C_5$ alkyl and alkali metal ions; and $R_2$ is selected from the group consisting of H and $C_1$-$C_{17}$ alkyl.

Preferably, $R_1$ is selected from the group consisting of $C_1$, $C_2$, $C_3$ alkyl and $Na^+$.

Preferably, $R_2$ is selected from the group consisting of $C_1$-$C_9$ alkyl; more preferably, $R_2$ is $C_1$, $C_2$ or $C_3$ alkyl.

According to a preferred embodiment of the present invention, the compound of formula (I) is selected from the group consisting of methyl 3-hydroxybutyrate; ethyl 3-hydroxybutyrate; methyl 4-hydroxybutyrate; methyl 3-hydroxyvalerate; ethyl 3-hydroxyvalerate; methyl 3-hydroxyhexanoate; ethyl 3-hydroxyhexanoate; sodium 3-hydroxybutyrate; methyl lactate; and ethyl lactate.

Preferably, the fuel is selected from the group consisting of an alcohol fuel, gasoline and diesel. In particular, the alcohol fuel is selected from the group consisting of ethanol, n-propanol and n-butanol.

It may be appreciated that the fuel, the fuel additive or the fuel composition of the present invention can contain multiple compounds of formula (I). For example, in a particularly preferred embodiment of the present invention, mcl HA methyl esters contain methyl 3-hydroxyhexanoate, methyl 3-hydroxyoctanoate, methyl 3-hydroxydecanoate, methyl 3-hydroxydodecanoate and the like.

Because of the convenience in preparation, methyl hydroxyalkanoates or ethyl hydroxyalkanoates of the present invention are particularly preferred.

The hydroxyalkanoic acid derivatives provided by the present invention can be used directly as fuels, and have the advantages such as high combustion heat, no emission of pollutants, etc. When used as fuel additives in combination with other fuels, the hydroxyalkanoic acid derivatives of the present invention can improve their combustion heat and other properties such as antiknock.

DETAILED DESCRIPTION OF THE INVENTION

Figure 1A:
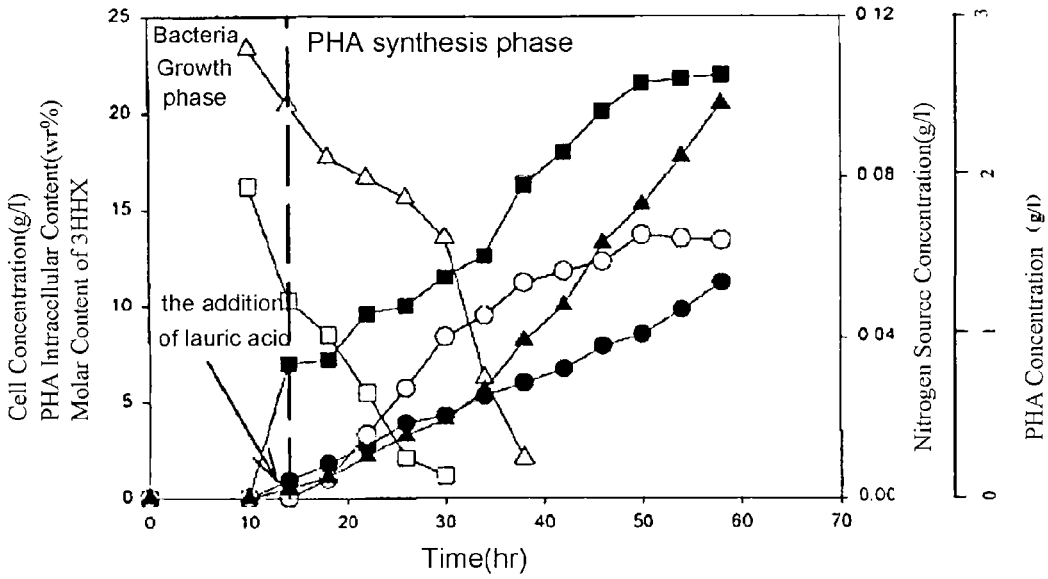
FIGS. 1*a*-1*a* show Fermentation time VS Nutrients VS Fermentation Related Parameters under the conditions of Fermentation A-C as shown in Table 1.

The term "alkyl" as used herein refers to a saturated aliphatic hydrocarbon group with given number of carbon atoms, having a branched chain or straight chain. For example, "$C_1$-$C_9$ alkyl" is defined as a straight chain or branched chain saturated aliphatic hydrocarbon group with 1, 2, 3, 4, 5, 6, 7, 8 or 9 carbon atoms. For example, "$C_1$-$C_9$ alkyl" particularly includes methyl, ethyl, n-propyl, iso-propyl, n-butyl, tert-butyl, iso-butyl, pentyl, hexyl, heptyl, octyl, nonyl, etc.

The term "lower alkyl" as used herein refers to an alkyl with no more than 5 carbon atoms. Particularly preferred "lower alkyl" of the present invention includes methyl and ethyl.

The term "alkali metal ion" as used herein refers to a metal ion of the first main group in the periodic table, including, but not limited to, $Na^+$, $K^+$, $Li^+$, etc.

In the context of the present invention, the terms "hydroxyalkanoic acid" and "HA" can be used interchangeably. Examples of hydroxyalkanoic acid derivatives include, but are not limited to, methyl 3-hydroxybutyrate or 3HB methyl ester, methyl 4-hydroxybutyrate or 4HB methyl ester, ethyl 3-hydroxybutyrate or 3HB ethyl ester, methyl 3-hydroxyhexanoate or 3HHx methyl ester, ethyl 3-hydroxyhexanoate or 3HHx ethyl ester, 3-hydroxyhexyl acid (3HHx), etc.

The term "mcl PHA" or "medium chain length PHA" as used herein refers to a specific medium chain length PHA polymer, including various HA monomers, the preparation method and composition of which are described in Example 2."mcl HA methyl ester" refers to the mixture of methyl esters of various monomers obtained from alcoholysis of mcl PHA, the composition of which is shown in Table 4.

Obtaining the hydroxyalkanoic acid derivatives of the present invention from PHA has many advantages. For example, PHA producers are very plentiful. Many microorganisms in various environments in nature have the ability to synthesize PHA. The source of substrate to synthesize PHA is also very wide, which may include most of organic substances. The substrates of commercialized poly-3-hydroxybutyrate (PHB), co-polymer of 3-hydroxybutyric acid and 3-hydroxyvaleric acid (PHBV), co-polymer of 3-hydroxybutyric acid and 3-hydroxyhexanoic acid (PHBHHx), etc., can be derived from cheap starch or palm oil, etc. The study showed that PHB biosynthesis pathway widely exists in many bacteria, and PHB can be synthesized by many bacteria in active sludge using organic pollutants in waste water as carbon source. The requirement to fermentation condition is simple. Conventional devices for antibiotics fermentation, ethanol fermentation, lactic acid fermentation, etc. are not required to change or only a little change is required for PHA fermentation. More competitive means of fermentation is the device of sewage treatment. A large amount of active sludge can be obtained from various devices of sewage treatment. In fact, the main components of active sludge are microbes, in particular, bacteria cells, and can be used directly to produce PHB. Various bacteria in the active sludge are not required to change or only a little change is required in order to use the organic pollutants in the sewage to produce PHB. Tens of million tons of active sludge are produced during the treatment of waste water in China every year, most of which are landfilled, burned or used for firedamp fermentation. To obtain fuels from active sludge is an excellent and mutual beneficial solution.

In the present invention, various lower alkyl hydroxyalkanoates obtained from PHA synthesized by microorganisms, if used as fuels, can enrich the current field of biofuel, and possess favorable social and economical benefits. These lower alkyl hydroxyalkanoates (e.g. methyl ester or ethyl ester) as fuels have suitable combustion heat and no emission of pollutants, can be used in combination with common fuels such as gasoline, and can improve the combustion of fuels such as gasoline and increase their octane number.

The lower alkyl hydroxyalkanoates of the present invention as fuels particularly include, but are not limited to, methyl 3-hydroxybutyrate, methyl 4-hydroxybutyrate, ethyl 3-hydroxybutyrate, the mixture of methyl 3-hydroxybutyrate or ethyl 3-hydroxybutyrate and methyl 3-hydroxyvalerate or ethyl 3-hydroxyvalerate in various molar ratios, the mixture of methyl 3-hydroxybutyrate or ethyl 3-hydroxybutyrate and methyl 3-hydroxyhexanoate or ethyl 3-hydroxyhexanoate in various molar ratios, the mixture of methyl or ethyl 3-hydroxy medium chain length alkanoate, the mixture of methyl 3-hydroxybutyrate or ethyl 3-hydroxybutyrate and methyl 4-hydroxybutyrate or ethyl 4-hydroxybutyrate in various molar ratios, methyl 3-hydroxypropionate or ethyl 3-hydroxypropionate, methyl 2-hydroxypropionate or ethyl 2-hydroxypropionate, etc.

The hydroxyalkanoates of the present invention can be mixed with fuels such as gasoline. According to many studies, it has been shown that the thermal efficiency for direct combustion of various biomass, such as straw, is very low, only about 10%, and the other 80%-90% energy is wasted. However, when they are converted into gas or liquid fuels, such as methane and ethanol, their thermal efficiency can be increased to more than 30%-40%. The conversion of solid, loose polyhydroxyalkanoic acid into liquid hydroxyalkanoates also has positive effect on the combustion efficiency.

The carbon content especially $CH_2$ content of a fuel has great effect on the combustion heat of the fuel. With the increase of carbon content in fuel, the combustion heat shows an increase tendency. Since bioethanol has a low carbon content, the combustion heat of bioethanol is 27.3 KJ/g. However, in the absence of energy, ethanol can be used to substitute gasoline as a fuel. In addition, it is discovered in the study of ethanol/gasoline mixed fuel that the mixture of ethanol and gasoline can improve the antiknock properties of gasoline because of the high oxygen content in ethanol molecule, thereby this mixed fuel may substitute the conventional plumbum containing antiknock agent and avoid the toxicity of conventional antiknock agent. Compared to fuel ethanol, hydroxyalkanoates can better improve the antiknock property of gasoline since the hydroxyl (—OH) in themselves and the ester bond introduced by esterification increase the oxygen content of hydroxyalkanoates.

The following data of combustion heat are obtained from combustion heat measurement: 3HB methyl ester: 19.43 KJ/g; Medium Chain Length PHA (MCLPHA methyl ester): 36.5 KJ/g; ethanol: 27.32 KJ/g; 0# diesel (produced by Guangdong Branch, Sinopec, and sold by Tuopu Gas Station, Shantou): 54.6 KJ/g; 90# gasoline: 52.4 KJ/g. 3HB methyl ester:ethanol: 32.88 KJ/g; 3HB methyl ester:90# gasoline: 46.25 KJ/g; 3HB methyl ester:0# diesel: 49.15 KJ/g (wherein 3HB methyl ester:ethanol=1:9; 3HB methyl ester:diesel=1:9; 3HB methyl ester:gasoline=1:9).

The combustion heat of 3HB methyl ester is a little lower than ethanol.

It was discovered from the mixture of 3HB methyl ester and other fuels that the addition of 3HB methyl ester surprisingly increased the combustion heat of ethanol, but did not increase the combustion heat of 0# diesel or 90# gasoline. Compared to the combustion heat of pure 0# diesel (54.6) and 90# gasoline (52.4), the combustion heat values of corresponding mixed fuels are 46.2 KJ/g and 49.1 KJ/g, respectively, which are still kept at a relative high level. As for the use of fuel, 3HA methyl esters can be used as fuels or be added into conventional fuels.

The hydroxyalkanoates of the present invention can also be used as fuels directly.

With the improvement of fermentation and extraction process, the cost of commercial production of poly-3-hydroxybutyrate (PHB) becomes lower and lower, which makes possible the direct use of methyl 3-hydroxybutyrate or ethyl 3-hydroxybutyrate as a fuel. Similarly, methyl 3-hydroxybutyrate or ethyl 3-hydroxybutyrate also has the advantages such as a high combustion heat, zero emission of pollutants, etc. When it is directly used as a fuel for combustion, methyl 3-hydroxybutyrate or ethyl 3-hydroxybutyrate can substitute ethanol in the spirit lamp and show similar properties to ethanol, such as high ignition point, blue outer flame, yellow inner flame, etc. Besides direct combustion, the use of hydroxyalkanoates, such as methyl 3-hydroxybutyrate or ethyl 3-hydroxybutyrate, as fuels can be firstly considered as motor fuels.

According to a preferred aspect of the present invention, active sludge can be used to produce polyhydroxyalkanoates (PHA). Existing processes for treating active sludge are used to produce PHA, which mainly include three types: (a) conventional process; (b) nitrification-denitrification process; (c) anaerobic-aerobic process. In general, anaerobic-aerobic process is preferred for PHA production. During the anaerobic-aerobic active sludge process, microorganisms in the active sludge can synthesize 15%~33% PHA depending on the regulation of organic content in the pollutants and ventilation, without any modification of the process and any addition of nutrients, which makes the low cost of PHA production possible. Another method is to modify common bacterial flora in the three active sludge processes by genetic engineering. The method of genetic modification is mainly to construct a safe, stable and efficient plasmid with a wide host range, thereby the absolute amount of PHA synthesized by the genetic modified microorganisms in the active sludge is increased.

Organic solvent extraction is mainly used in PHA extraction. The organic solvent is preferably selected from esters, such as ethyl acetate, butyl acetate, etc. Esters have the advantages of low cost, good miscibility with PHA and non-toxicity, and can be mixed with methyl hydroxyalkanoate or ethyl hydroxyalkanoate as a fuel. After simple separation and purification, PHA liquid can react directly with sodium hydroxide or sulfuric acid, methanol or ethanol for alcoholysis to prepare methyl hydroxyalkanoate or ethyl hydroxyalkanoate and can be used as a fuel with extraction solvents, such as ethyl acetate or butyl acetate.

EXAMPLES

Example 1

The Production of PHA Using Active Sludge

Figure 2:
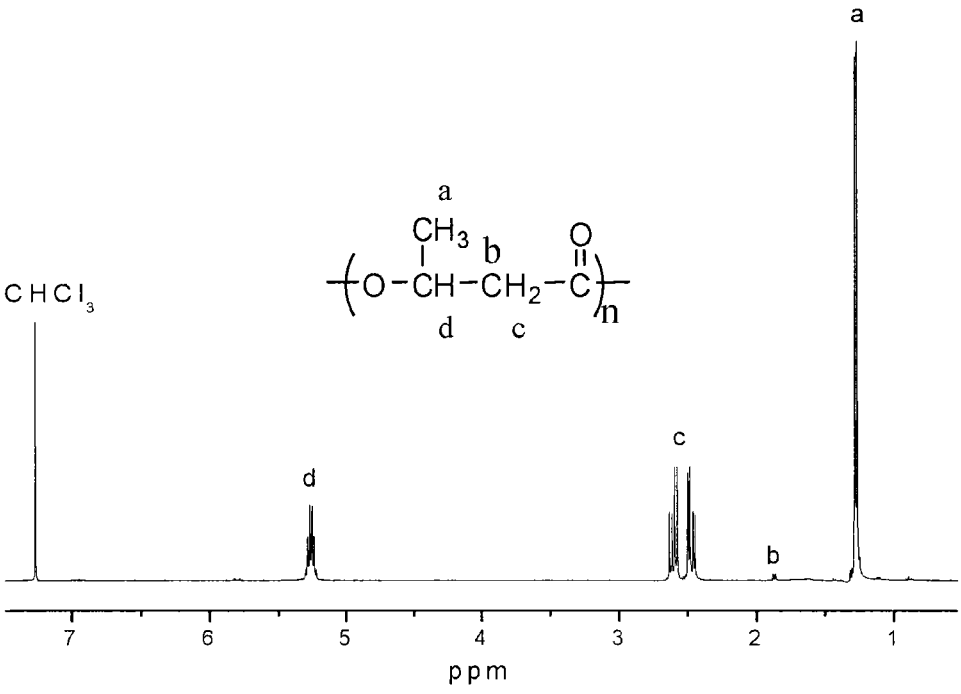
FIG. 2 shows PHB $^1$H NMR structure.

The production of PHA using active sludge was simulated in the laboratory with bench scale equipments with reference to the study on the production of PHA using anaerobic-aerobic active sludge (EBPR) (Iwamoto, et al., *Proc. Environ. Eng. Res* 31 (1994) 305-314; Satoh, et al., *Water. Sci. Technol* 38 (1998) 103-109; Satoh, et al., *Int. J. Biol. Macromol.* 25 (1999) 105-109; Yue, et al. *Technol. Water Treatment,* 30 (2004); Chen, et al. *Agro-Environmental Protection,* 20 (2003) 424-428). The experimental device utilized in this Example was sequencing batch reactor (SRS) (see *Agro-Environmental Protection*, pages 329-332 No. 5, 2001), consisting of elevated tank, water storage tank, pump, solenoid valve, LOGO time controller and aeration equipment. The quantitative volume of elevated tank was 2 L and the volume of SBR solvent was about 5 L. Additional acetic acid was added as carbon source. Artificial wastewater was prepared with COD of about 1000 mg/L by using acetic acid as substrate. During the preparation of wastewater, ammonium chloride, potassium dihydrogen phosphate, magnesium sulfate heptahydrate, potassium hydrogen phosphate and calcium chloride (the above chemicals were produced by Beijing Chemical Plant, analytical grade) were added at 5 mg/L as nutrients in order to balance the nutrition. pH value was kept at 6.8~7.1. Sludge used in the experiments was mainly the active sludge collected from the anaerobic-aerobic active sludge process (EBPR) (see Chen, et al. *Agro-Environmental Protection,* 20 (2003) 424-428). The collected active sludge (from sewage treatment station, Siming Yantang Milk Corp., Guangzhou) was filtered, washed by physiological saline and aerated for 4 hrs to degrade the suspended or gel matter, and then was disposed into the reactor. Every experimental cycle was 8 hrs, three cycles per day. Every cycle was arranged as follows: water injection 2 min, aeration 240 min, precipitation 180 min, supernatant emission 30 min. The whole time was controlled by LOGO time controller. The concentration of sludge in the reactor was kept at about 1800~400 mg/L, and pH was kept at about 6.8~7.1. The sludge was cultured more than 3 weeks for acclamation. After COD removal was over 85%, that is, the sludge had adapted the single substrate environment and the bacteria were relatively homogeneous, water samples and sludge samples were obtained and analyzed. The COD degradation of wastewater was observed. Then, the effect of acetic acid concentration on the formation of PHB was also observed. Start concentration of acetic acid was 0.26 mg/L. 3 weeks later, i.e. Day 23, the curve of COD degradation VS PHB production was made. After Day 28, the parameters were modified to increase acetic acid concentration to 0.42 mg/L. Then, the curve of COD degradation VS PHB production was made again after the acclamation for another 3 weeks, i.e. on Day 51. Both results were compared to study the effect of the change of acetic acid concentration on PHB production. The qualitative method for PHB was mainly Sudan black dying and NMR analysis (FIG. 2). The quantitative method was mainly gas chromatography. The results showed that intracellular content of PHB can reach about 35% (w/w) (For details, see Luo, et al. *Journal of Applied Polymer Science* 2007 105: 3402-3408; Ouyang, et al. *Biomacromolecules* 2007 8: 2504-2511).

Example 2

The Extraction of PHA and the Preparation of Methyl Hydroxyalkanoate or Ethyl Hydroxyalkanoate PHA was extracted from active sludge using organic solvent extraction with reference to related studies on organic solvent extraction (Chen, et al. *Appl. Microbiol. Biotechnol,* 57 (2001) 50-55; Chen, et al. Chinese Patent No.: CN1844185, 2006-04-13; Chen, et al. Chinese Patent Application No.: 02130725.3). After the sewage treatment using active sludge, the active sludge was automatically separated from treated clean water, and the precipitated active sludge was sent into conventional incineration equipment to dry. Then, ethyl acetate or butyl acetate (Beijing Chemical Plant, analytical grade) was added with the ratio of 1:5~1:7 (active sludge: organic solvent). After heated at 90° C.~100° C. for reflux and stirred for 30~50 min, PHA dissolved into ethyl acetate or butyl acetate to form dilute PHA solution. After standing still, the solid and the liquid separated automatically. The corresponding liquid was isolated, and methanol or ethanol was added into the liquid, while PHA was precipitated as flocculent or massive precipitate. The method of organic solvent extraction could make a PHA yield more than 95% (w/w) of the theoretical intracellular content as calculated by gas chromatography method (Agilent Technologies Inc. US). The corresponding alcoholysis was performed under heating at 90~100° C. for reflux with sodium hydroxide or concentrated sulfuric acid as catalyst. The obtained solution could be directly used as a fuel for combustion. If necessary, certain purification could be performed to obtain the methyl hydroxyalkanoate or ethyl hydroxyalkanoate with a higher purity.

Example 3

The Production of Poly-3-hydroxybutyric Acid-3-hydroxyhexanoic Acid (PHBHHx) by Fermentation Using Lauric Acid or Other Organics as Carbon Source and *Aeromonas hydrophila* 4AK4 as Producer Experimental conditions were based on Chen, et al. *Appl Microbiol Biotechnol* 2001 57: 50-55.

The fermentation of PHBHHX was made by batch fermentation. The seed was prepared in LB medium, then seed culture was transferred to 1000 ml flask with indentation containing 400 ml LB medium and cultured at 30° C. for 12 hrs. Seed broth was transferred to 4000 L fermenter containing 2000 L glucose/yeast extract medium. The fermentation condition was provided as follows: agitation speed 250 rpm, aeration 20000 L/h, culturing temperature 30° C., fermentation time 12 hrs (cells were grown to exponential phase). 1 L glucose/yeast extract medium included the following components: 16 g glucose, 1.5 g potassium dihydrogen phosphate, 1 g ammonium sulfate, 4.5 g disodium hydrogen phosphate, 0.2 g magnesium sulfate heptahydrate, 0.05 g calcium chloride dihydrate, 0.5 g yeast extract and 1 ml trace elements solution (for the formula of trace elements, see Xi, et al. *Antonie van Leeuwenhoek* 78 (2000) 43-49). 2000 L seed broth in exponential phase was aseptically transferred to 20000 L fermenter containing 10000 L growth medium. The components of growth medium were shown in Table 1.

By the element analysis of *A. hydrophila* 4AK4, concentrations of ammonium salt and phosphate at the start feed were calculated, thereby the subsequent limitation of nutrients was determined. The whole fermentation process was mainly divided into two phases: the first phase was bacteria growth phase using glucose as carbon source, in which the limitation of nutrients was not required; the second phase was PHBHHx accumulation phase using lauric acid as carbon source, in which the limitation of nitrogen or phosphor was required to facilitate the product accumulation. When the concentration of glucose decreased to 10 g/L (Fermentations A and B in Table 1) or 20 g/L (Fermentation C in Table 1), lauric acid (400 g/L) dissolved in 50° C. hot water was aseptically added into 20000 L fermenter by compressed air. In the bacteria growth phase, the rotation rate of fermentation was kept at 120 rpm, the aeration was 200000 L/h, and pH was 7.0. In the PHBHHx accumulation phase, the aeration decreased to 100000 L/h, pH 6.5. The regulation of pH was realized by the addition of 20% (w/v) sodium hydroxide into fermentation medium.

Figure 1B:
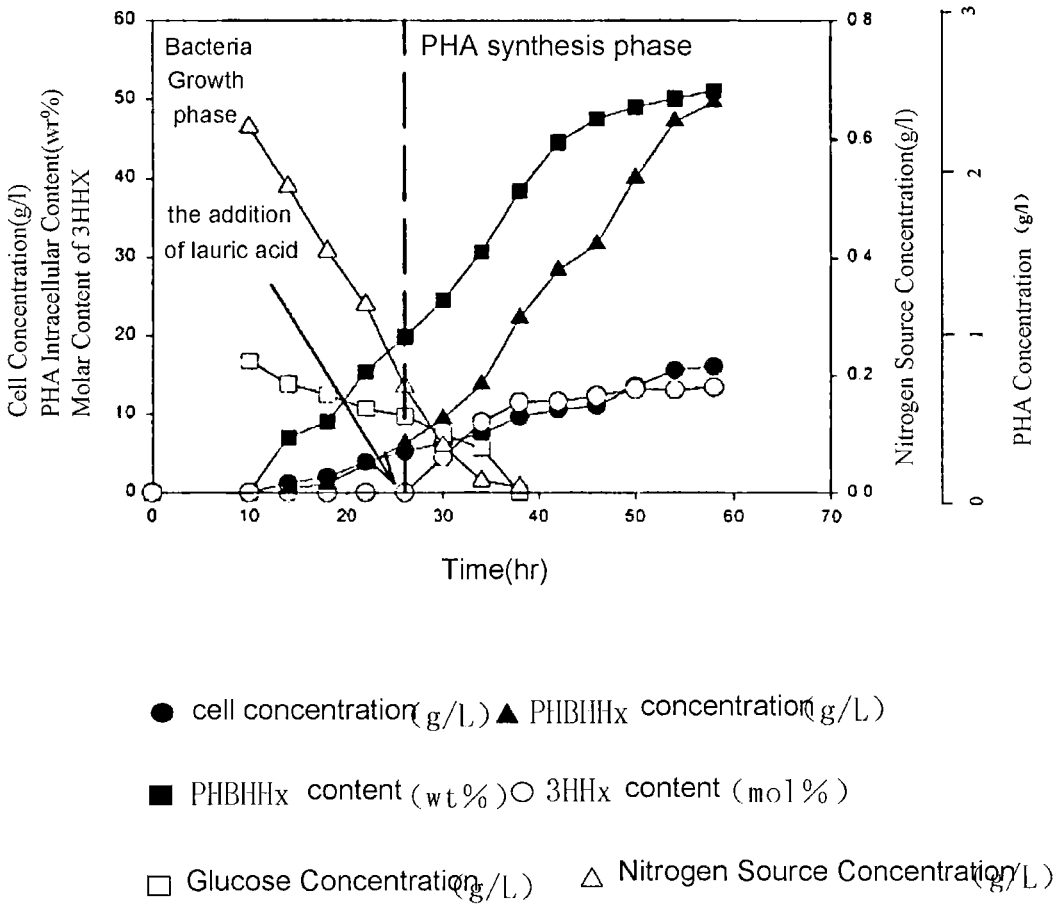
Figure 1C:
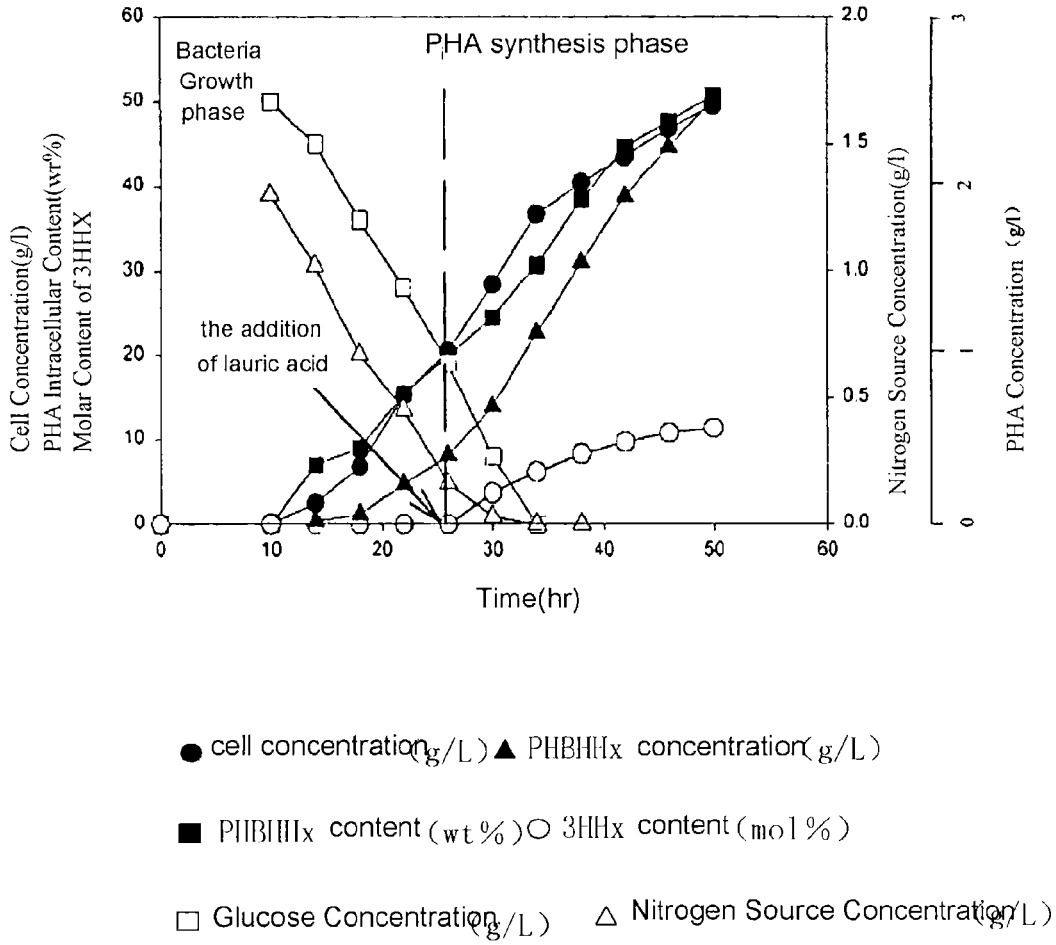

Fermentation results were shown in FIG. 1. Final fermentation results showed that after fermentation for 46 hrs, cell concentration, PHBHHx concentration and intracellular content of PHBHHx were 50 g/L, 25 g/L and 50% (w/w), respectively. PHBHHx analysis and extraction steps were similar to those in Examples 1 and 2, and can be properly modified according to particular devices.

Example 4

The Production of PHA by Mixed Fermentation of Multiple Bacteria

PHA was produced using mixed bacteria culture with reference to Zhang, et al. *Acta Microbiologica Sinica* 43 (2003). Considering the wide applicability of various active sludge treatment processes, such as nitrification-denitrification process and anaerobic-aerobic process, mixed fermentation of common bacteria flora in these processes was employed in the laboratory simulation. Main bacteria include *Azotobacter chroococcum* mutant G-3, *Bacillus megaterium, Comamonas acidovorans* and *Pseudomonas putida*, etc. The main components in 1 L liquid medium include: sucrose 20 g, potassium hydrogen phosphate 0.8 g, potassium dihydrogen phosphate 0.2 g, magnesium sulfate heptahydrate 0.2 g, calcium carbonate 0.5 g, ferric chloride heptahydrate 0.125 g, peptone 1 g, trace elements 1 ml (the formula of trace elements was the same as Example 3). Culture condition was provided as follows: first, the culture was performed in 250 ml conical flask containing 30~40 ml medium, 30° C., 220 rpm. Then, NBS Automatic Fermenter was used for fermentation with temperature self-controlled at 30° C., pH 6.9~7.2, intermittent regulation of alkali liquor, start agitation speed 600 rpm, aeration 1:1, start liquid volume 1.2 L, inoculum size 10% and fed-batch fermentation. The order of addition of bacteria was that *Azotobacter chroococcum* and *Pseudomonas putida* were added first and cultured 22~28 hrs, then *Bacillus megaterium* and *Comamonas acidovorans* were added at an inoculum size of 10% with the simultaneous addition of 0.5% (w/v) peptone and 0.5% (w/v) ammonium nitrate, and continued the culture for 42~46 hrs. During the culture, sucrose concentration in the fermenter was measured at regular intervals. When sucrose concentration in the fermenter decreased to about 0.3%~0.5% (w/v), automatic feed pump was started. The sucrose concentration in the fermenter was kept at about 2% (w/v) by supplying 30% (w/v) sucrose solution. Final fermentation results showed that after mixed culture of multiple bacteria for 66~74 hrs, cell dry weight could reach 32 g/L, PHA content could reach 75% (w/w), and the conversion rate of PHA from sugar was 0.32.

Example 5

The Preparation of 3HA Methyl Ester and the Determination of its Combustion Heat The preparation of 3HB methyl ester was conducted with reference to the literature (Roo, et al. *Biotechnology and Bioengineering* 2002 6.717-722; Lee, et al. *Biotechnology and Bioengineering* 1999 65. 363-368). The details were provided as follows: 15 g PHB was dissolved in 200 ml chloroform, then the same volume of sulfuric acid/methanol solution (the ratio of sulfuric acid/methanol solution was 15 parts (volume) sulfuric acid vs 85 parts (volume) methanol) was added. This mixed solution was refluxed at 100° C. for 48 hrs. After reflux for 48 hrs, the solution was cooled to room temperature and transferred to a separatory funnel. 40 ml saturated sodium chloride solution was added into the separatory funnel, shaked violently for 10 min, stood still and the partition between organic phase and water phase could be observed. Lower organic phase was isolated and washed by deionized water several times. The organic phase was transferred to a round-bottom flask and chloroform therein was removed by rotatory evaporation to obtain 3HB methyl ester as a thick liquid. Other 3HA methyl esters were prepared by the same method (all of the above reagents were available from Xilong Chemical Plant, Shantou, analytical grade).

Combustion heat determination assay of 3HA methyl esters was performed by BH-IIIS Combustion Heat Detector, a new product of Nanjing Nanda Wanhe Technology Co., Ltd. Heat capacity of the detector was determined to be 15.6 KJ/° C. as calibrated by using benzoic acid having a known combustion heat. The combustion heat determined by this detector was constant volumetric combustion heat, represented by symbol Qvs. The equation of constant volumetric combustion heat was $C\Delta_t = m_s Q_{vs} - 1.4\ m_h$ (in which C represented heat capacity of the detector, $\Delta_t$ represented temperature difference, $m_s$ represented the mass of sample, $Q_{vs}$ represented constant volumetric combustion heat of the sample to be detected, $m_h$ represented the mass of burned nickel-chromium wire). $\Delta_t$ was required to be calibrated by Reynold's Mapping (see FIG. 3).

Figure 3:
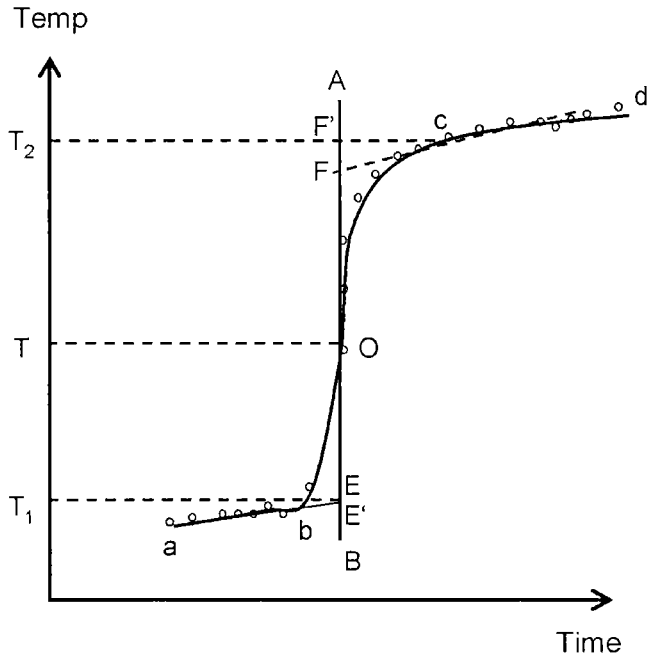
FIG. 3 shows the calibration graph of Reynold's Mapping.

FIG. 3 showed the change of temperature obtained by combustion heat detector. Since the heat insulation property of combustion heat detector could not completely avoid the heat exchange between the system and the environment, temperature-time curve of combustion determination should be calibrated to obtain the correct result. The definition of temperature-time curve was provided as follows: ab was the baseline, representing the temperature of water as medium in the calorimeter before the combustion reaction. When ab was a straight line in parallel with the time axis or a slanting line with a constant slope, it showed that the temperature of calorimeter was stable. be represented the temperature change of water as medium in the calorimeter after the combustion reaction. From b point, the combustion reaction released a large amount of heat, causing the water temperature to increase rapidly in a short period, until the curve showed a turn to c point. cd represented that the system temperature tended to be stable after rapid increase. According to Reynold's Mapping, the peak height of temperature-time curve was measured to obtain the correct result. Straight lines were made across c point and b point and in parallel with the time axis, respectively, and crossing the temperature axis at T1 point and T2 point, respectively. Across T1-c and T2-b straight lines, a straight line AB was made vertical to temperature axis and crossing b-c curve at middle point O. Reverse extension line was made along c-d and a-b, crossing AB at E point and F point. Therefore, the distance between E point and F point was the temperature difference $\Delta_t$. in the equation.

The determination of constant volumetric combustion heat was summarized as follows: (I) The heat capacity of device was calibrated by using benzoic acid which has a known combustion heat. (a) 0.8~1 g benzoic acid was weighed and pressed into pieces by infrared presser. After unshaped powders were removed by wind tube, benzoic acid pieces were weighed again and recorded. (b) After the bomb lid was opened, pre-weighed nickel-chromium wire was bent to form a loop in the middle and was enlaced around both electrodes of the bomb carefully and tightly. The sample was placed into combustion boat of the bomb, and nickel-chromium wire was made to stick to sample tightly by the elasticity of nickel-chromium wire (Note: the nickel-chromium wire could not contact the combustion boat). A multimeter was used to check whether the circuit was closed. If the circuit was closed, the bomb lid was screwed tightly and the circuit was checked again. (c) According to the requirement of bomb aeration, the bomb was filled with 1~1.2 MPa oxygen. (d) The multimeter was used again on both electrodes to check whether the circuit was closed. If the circuit was closed, the bomb was placed into the combustion heat detector. 3 L tap water was accurately poured into the inner tube which accommodated the bomb. The stirring switch was opened and the temperature change was observed. When the temperature baseline was parallel with time axis, i.e. abscissa, or the tangent was a straight line, the ignition was done. After the ignition, the temperature increased sharply, and finally tended to be stable until the temperature line was parallel with abscissa. According to the experience, time limit was typically set at 35 min. (II) The combustion heat determination of 3HA methyl esters and other fuels. General steps were similar to the combustion heat determination of benzoic acid as above. The difference was that 3HA methyl esters were liquid samples. Because 3HA methyl esters had higher boiling points, samples can be added directly into combustion boat when only 3HA methyl esters were detected. For volatile samples with a lower boiling point, they could be put in small plastic bags with a known combustion heat for detection. Testing results were shown in Table 2.

Mcl PHA used in this Example was produced by *Pseudomonas putida* KTOY06 constructed by Dr. Ouyang Shaping of Tsinghua University using lauric acid (dodecanoic acid) as carbon source, the components of which were shown in Table 4. Detailed production process was with reference to Ouyang S P, Luo R C, Chen S S, Liu Q, Chung A, Wu Q, Chen G Q (2007a) Production of polyhydroxyalkanoates with high 3-hydroxydodecanoate monomer content by fadB and fadA knockout mutant of *Pseudomonas putida* KT2442. *Biomacromolecules* 8: 2504-2511; and Liu W K, Chen G Q (2007) Production and characterization of medium-chain-length Polyhydroxyalkanoate with high 3-hydroxytetradecanoate monomer content by fadB and fadA knockout mutant of *Pseudomonas putida* KT2442. *Appl Microbiol Biotechnol* 76: 1153-1159. The preparation method of mcl HA methyl esters (mcl HAM) was the same as that of 3HB methyl ester (3HBM).

It could be seen that: among 3HA methyl esters, 3HB methyl ester has the lowest combustion heat; and with the increase of carbon atoms, their combustion heat increased, wherein the combustion heat of MCL methyl ester was about 36.5 KJ/g. The combustion heat of 3HB methyl ester was a little lower than ethanol.

When 3HB methyl ester was mixed with other fuels, it could be seen that the addition of 3HB methyl ester could increase the combustion heat of ethanol. However, the addition of 3HB methyl ester did not increase the combustion heat of 0# diesel or 90# gasoline. Compared to the combustion heat of pure 0# diesel (54.6 KJ/g) and 90# gasoline (52.4 KJ/g), the combustion heat of mixed fuels were about 46.2 KJ/g and 49.1 KJ/g, respectively, which were still kept at a relative high level.

With the increase of the proportion of 3HB methyl ester or MCL methyl ester in mixed fuels, the combustion heat of mixed fuels did not show a significant tendency of increase or decrease, but was kept at a relatively stable level. Similar to 3HB methyl ester, the addition of MCL methyl esters in the mixed fuel of a MCL methyl ester and ethanol also increased the combustion heat of ethanol, and the extent of increase was generally higher than that in relation to 3HB methyl ester. Specific reasons were still unknown. One possible reason was that 3HA esters and ethanol generated additional reaction heat during the combustion, thereby causing the combustion heat of whole mixed fuel to increase. In contrast to the expected result, the addition of MCL methyl ester, in various weight ratios, into diesel or gasoline did not increase the combustion heat of diesel or gasoline, which was still lower than the combustion heat of pure diesel or gasoline. At the same time, there was no much difference between the effect of MCL methyl ester and that of 3HB methyl ester. The reason might exist in the long carbon chain of MCL methyl esters (generally over eight carbon atoms). During the combustion, MCL methyl esters might be carbonized and insufficiently combusted, causing incomplete combustion, thereby the combustion heat could not be emitted completely. As for this problem, some improvements such as decreasing sample amount, increasing combustion thread had been done. However, there was no significant effect. It could be imagined that during the combustion, with the increase of carbon atoms, the combustion heat might not increase correspondingly. Besides the quality of fuel itself, whether the fuel can be combusted sufficiently or not is also another consideration. When MCL methyl esters and gasoline or diesel were mixed for combustion, gasoline or diesel, especially diesel, often showed insufficient combustion. Therefore, the addition of MCL methyl ester with a long carbon chain intensified the insufficient combustion. This may be one of the reasons why the combustion heat of mixed fuel cannot be increased effectively.

It could be seen from these combustion heat results that 3HA methyl esters especially 3HB methyl ester are valuable as fuels. The combustion heat of the fuels mixed with 3HB methyl ester or a MCL methyl ester in various weight ratios did not show great difference. Therefore, it was enough to use the lowest amount of 3HB methyl ester or a MCL methyl ester. Since there is no significant difference between MCL methyl esters and 3HB methyl ester, it is more desirable to develop 3HB methyl ester as a fuel.

Furthermore, both 3HB methyl ester and MCL methyl ester, especially MCL methyl ester, could substantially increase the combustion heat of ethanol after mixed with ethanol, which was a new finding. In addition, another exciting result was that a small amount of 3HA methyl ester or MCL methyl ester could increase the combustion heat of ethanol substantially, which was desirable in commercial development. It could be expected that in future where green fuels such as ethanol become main fuels, the development of 3HA methyl ester fuel and 3HA methyl ester/ethanol mixed fuel will show great potential of application, thereby providing a great chance for the development and application of 3HA methyl esters as fuels and promoting the improvement of the quality of ethanol fuel. Furthermore, 3HA has —OH and —COOH groups which can be easily modified, thus it is very convenient to produce many derivatives with interesting properties based on 3HA. These derivatives as green bioadditives for fuels may improve the properties of fuels, such as combustion heat or combustion efficiency. Thus, some experiments were performed to confirm whether 3HB methyl ester, sodium 3HB and MCL methyl ester could increase the combustion heat of the three alcohol fuels, i.e. ethanol, n-propanol and n-butanol.

Example 6

3-Hydroxyalkanoic Acid Derivatives Increased the Combustion Heat of Alcohol Fuels The testing method and data processing were similar to those described above. In this Example, besides 3HB methyl ester and MCL methyl ester, another 3HA derivative, i.e. sodium 3HB was also used in the study. Sodium 3HB cannot combust by itself It is desired to compare the effect of the addition of 3HB methyl ester or MCL methyl ester, which could combust by itself, on the combustion heat of alcohol fuels with the addition of sodium 3HB which cannot combust by itself Detailed results were shown in Table 3.

Similar to results in Table 2, both 3HB methyl ester and MCL methyl ester could increase the combustion heat of ethanol substantially. In particular, MCL methyl ester showed a significant increase. With the increase of the proportion of 3HB methyl ester or MCL methyl ester in mixed fuels, the combustion heat of mixed fuels did not show a regular increase, but was kept at a relatively stable level. In addition, it was found that the addition of sodium 3HB which cannot combust by itself could also increase the combustion heat of ethanol fuel, and the addition of only a small amount of sample of sodium 3HB could maintain the combustion heat of ethanol fuel at about 34.33 KJ/g.

During the experiment to increase the combustion heat of n-propanol, the combustion heat of pure n-propanol was 34.32 KJ/g. The addition of 3HB methyl ester or MCL methyl ester did not increase the combustion heat of n-propanol substantially, but both could maintain the combustion heat of mixed fuels at a stable level, both of which were a little higher than the combustion heat of pure n-propanol. At the same time, there was no great difference between the effect of 3HB methyl ester and that of MCL methyl ester. With the increase of the proportion of 3HB methyl ester or MCL methyl ester in mixed fuels, the combustion heat values of mixed fuels did not show a regular increase, but were kept at a relatively stable level. The addition of sodium 3HB which cannot combust by itself did not affect the combustion heat of n-propanol significantly.

During the experiment to increase the combustion heat of n-butanol, the combustion heat of pure n-butanol was 36.66 KJ/g. The addition of 3HB methyl ester did not change the combustion heat of n-butanol significantly. The combustion heat values of mixed fuels of 3HB methyl ester and n-butanol with various ratios were kept at a stable level. The addition of MCL methyl ester could increase the combustion heat of n-butanol up to 39 KJ/g. With the increased proportion of MCL methyl ester, the combustion heat of MCL methyl ester and n-butanol mixed fuel showed regular increase. Furthermore, the addition of a small amount of sodium 3HB which cannot combust by itself could also increase the combustion heat of n-butanol. The addition of sodium 3HB could increase the combustion heat of n-butanol to about 39 KJ/g.

TABLE 1

Medium Components in 20000 L Fermenter

| Nutrients (g/L) | Fermentation A nitrogen | Fermentation B phosphor | Fermentation C phosphor |
|---|---|---|---|
| Glucose a | 20 | 20 | 50 |
| Ammonium sulfate | 1 | 2 | 2 |
| Disodium hydrogen phosphate | 5.6 | 3.5 | 5.8 |
| Magnesium sulfate heptahydrate | 0.2 | 0.2 | 0.5 |
| Calcium chloride dihydrate | 0.05 | 0.05 | 0.1 |
| Trace elements solution b | 1 | 1 | 2 |
| Yeast extract | 0.5 | 0.5 | 1 |
| Lauric acid c | 20 | 20 | 50 |

a Glucose was added in the start growth medium.
b The unit of the concentration of trace elements solution was ml/L.
c Lauric acid was added at the time points shown in FIGS. 4a, 4b and 4c.

TABLE 2

The Combustion Heat of 3HB Methyl Ester, MCL Methyl Ester and Their Mixtures with Ethanol, Gasoline and Diesel in Various Proportions.

| Sample | Combustion heat | Sample | Combustion heat |
|---|---|---|---|
| 3HB methyl ester | 19.43 | 3HB methyl ester - diesel (1:9) | 49.15 |
| MCL methyl ester | 36.5 | 3HB methyl ester - diesel (2:8) | 42.64 |
| ethanol | 27.32 | 3HB methyl ester - diesel (3:7) | 47.57 |
| 0 # diesel | 54.62 | 3HB methyl ester - diesel (4:6) | 47.56 |
| 90 # gasoline | 52.45 | MCL methyl ester - diesel (1:9) | 43.58 |
| | | MCL methyl ester - diesel (2:8) | 45.55 |
| 3HB methyl ester-ethanol (1:9) | 32.88 | MCL methyl ester - diesel (3:7) | 42.53 |
| 3HB methyl ester-ethanol (2:8) | 35.56 | MCL methyl ester - diesel (4:6) | 43.22 |
| 3HB methyl ester-ethanol (3:7) | 35.57 | | |
| 3HB methyl ester-ethanol (4:6) | 35.57 | 3HB methyl ester - gasoline (1:9) | 46.25 |
| MCL methyl ester-ethanol (1:9) | 36.86 | 3HB methyl ester - gasoline (2:8) | 49.18 |
| MCL methyl ester-ethanol (2:8) | 39.64 | 3HB methyl ester - gasoline (3:7) | 49.13 |
| MCL methyl ester-ethanol (3:7) | 38.83 | 3HB methyl ester - gasoline (4:6) | 49.15 |

TABLE 2-continued

The Combustion Heat of 3HB Methyl Ester, MCL Methyl Ester and Their Mixtures with Ethanol, Gasoline and Diesel in Various Proportions.

| Sample | Combustion heat | Sample | Combustion heat |
|---|---|---|---|
| ethanol (3:7) | | gasoline (4:6) | |
| MCL methyl ester-ethanol (4:6) | 37.52 | MCL methyl ester - gasoline (1:9) | 49.32 |
| | | MCL methyl ester - gasoline (2:8) | 50.22 |
| | | MCL methyl ester - gasoline (3:7) | 50.83 |
| | | MCL methyl ester - gasoline (4:6) | 49.64 |

Note:
The unit of combustion heat was KJ/g. The ratio of mixed fuel was weight ratio (w/w).

TABLE 3

Experimental Data for the Increase of Combustion Heat of Alcohol Fuels Using 3HB Methyl Ester, Sodium 3HB and MCL Methyl Ester.

| Sample | Combustion heat | Sample | Combustion heat |
|---|---|---|---|
| ethanol | 27.32 | MCL methyl ester-n-propanol (1:9) | 36.66 |
| n-propanol | 34.32 | MCL methyl ester-n-propanol (2:8) | 36.66 |
| n-butanol | 36.66 | MCL methyl ester-n-propanol (3:7) | 36.27 |
| 3HB methyl ester | 19.43 | MCL methyl ester-n-propanol (4:6) | 38.22 |
| MCL methyl ester | 36.5 | sodium 3HB-n-propanol (0.01) | 36.66 |
| | | sodium 3HB-n-propanol (0.02) | 35.49 |
| 3HB methyl ester-ethanol (1:9) | 32.88 | | |
| 3HB methyl ester-ethanol (2:8) | 35.56 | 3HB methyl ester-n-butanol (1:9) | 37.64 |
| 3HB methyl ester-ethanol (3:7) | 35.57 | 3HB methyl ester-n-butanol (2:8) | 37.64 |
| 3HB methyl ester-ethanol (4:6) | 35.57 | 3HB methyl ester-n-butanol (3:7) | 39.39 |
| MCL methyl ester-ethanol (1:9) | 36.86 | 3HB methyl ester-n-butanol (4:6) | 35.49 |
| MCL methyl ester-ethanol (2:8) | 39.64 | MCL methyl ester-n-butanol (1:9) | 36.66 |
| MCL methyl ester-ethanol (3:7) | 38.83 | MCL methyl ester-n-butanol (2:8) | 38.61 |
| MCL methyl ester-ethanol (4:6) | 37.52 | MCL methyl ester-n-butanol (3:7) | 39 |
| sodium 3HB-ethanol (0.01) | 34.33 | MCL methyl ester-n-butanol (4:6) | 39 |
| sodium 3HB-ethanol (0.02) | 34.33 | sodium 3HB-n-butanol (0.01) | 39 |
| | | sodium 3HB-n-butanol (0.02) | 39 |
| 3HB methyl ester-n-propanol (1:9) | 36.66 | | |
| 3HB methyl ester-n-propanol (2:8) | 37.83 | | |
| 3HB methyl ester-n-propanol (3:7) | 36.66 | | |
| 3HB methyl ester-n-propanol (4:6) | 34.32 | | |

Note:
The unit of combustion heat was KJ/g. Sodium 3HB-ethanol (0.01) represented that 0.01 g sodium 3HB was added into 0.8 g ethanol; sodium 3HB-ethanol (0.02) represented that 0.02 g sodium 3HB was added into 0.8 g ethanol. The expressions in sodium 3HB-n-propanol and sodium 3HB-n-butanol were similar to that in sodium 3HB-ethanol.

TABLE 4

The Proportion of Various mcl HA Methyl Esters After the Alcoholysis of mcl PHA

| Sample | Mole Proportion (mol %) | | | |
|---|---|---|---|---|
| mcl PHA polymer | HHx 3.0 ± 0.1 | HO 22.9 ± 0.3 | HD 33.2 ± 1.0 | HDD 40.9 ± 1.4 |
| mcl HA methyl ester | HHx methyl ester 1.85 ± 1.2 | HO methyl ester 29.06 ± 0.8 | HD methyl ester 33.11 ± 2.1 | HDD methyl ester 35.98 ± 0.1 |

Note:
mcl PHA polymer was produced from the fermentation by *Pseudomonas putida* KTOY06;
HHx: 3-hydroxyhexanoate; HO: 3-hydroxyoctanoate; HD: 3-hydroxydecanoate; HDD: 3-hydroxydodecanoate.

The invention claimed is:

1. A fuel composition, including:

at least one fuel; and a compound of formula (I),

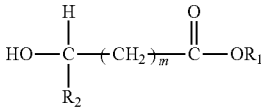

(I)

wherein, m is 1, 2, or 3;

$R_1$ is selected from the group consisting of $C_1$-$C_5$ alkyl and alkali metal ions; and $R_2$ is selected from the group consisting of H and $C_1$-$C_{17}$ alkyl.

2. The composition of claim 1, wherein $R_1$ is selected from the group consisting of $C_1$, $C_2$, $C_3$ alkyl and $Na^+$.

3. The composition of claim 1, wherein $R_2$ is selected from the group consisting of $C_1$-$C_9$ alkyl.

4. The composition of claim 1, wherein $R_2$ is $C_1$, $C_2$ or $C_3$ alkyl.

5. The composition of claim 1, wherein the compound of formula (I) is selected from the group consisting of methyl 3-hydroxybutyrate; ethyl 3-hydroxybutyrate; methyl 4-hydroxybutyrate; methyl 3-hydroxyvalerate; ethyl 3-hydroxyvalerate; methyl 3-hydroxyhexanoate; ethyl 3-hydroxyhexanoate; and sodium 3-hydroxybutyrate.

6. The composition of any one of claims 1-5, wherein the at least one fuel is selected from the group consisting of alcohol fuels, gasoline and diesel.

7. The composition of claim 6, wherein the alcohol fuel is selected from the group consisting of ethanol, n-propanol and n-butanol.

* * * * *

UNITED STATES PATENT AND TRADEMARK OFFICE

CERTIFICATE OF CORRECTION

PATENT NO. : 8,535,399 B2
APPLICATION NO. : 12/994330
DATED : September 17, 2013
INVENTOR(S) : Chen et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 43 days.

Signed and Sealed this
Fifteenth Day of September, 2015

Michelle K. Lee

Michelle K. Lee
*Director of the United States Patent and Trademark Office*